United States Patent [19]

Gilpatrick et al.

[11] 4,308,649

[45] Jan. 5, 1982

[54] APPARATUS TO PATTERN BRUSH PILE FABRIC

[75] Inventors: Michael W. Gilpatrick, Chesnee; Carroll L. Pack, Spartanburg, both of S.C.

[73] Assignee: Milliken Research Corporation, Spartanburg, S.C.

[21] Appl. No.: 149,211

[22] Filed: May 12, 1980

Related U.S. Application Data

[63] Continuation of Ser. No. 22,521, Mar. 21, 1979, abandoned.

[51] Int. Cl.[3] ..... D06C 23/02

[52] U.S. Cl. ..... 26/2 R

[58] Field of Search ..... 26/2 R, 16, 29 P, 30; 28/160

[56] References Cited

U.S. PATENT DOCUMENTS

| | | | |
|---|---|---|---|
| 185,587 | 12/1876 | Smith | 26/30 |
| 194,057 | 8/1877 | Smith | 26/30 |
| 397,064 | 1/1889 | Behnisch | 26/30 |
| 2,035,641 | 3/1936 | Dickie et al. | 26/2 R |

FOREIGN PATENT DOCUMENTS

| | | | |
|---|---|---|---|
| 763289 | 7/1971 | Belgium | 26/16 |
| 768988 | 11/1971 | Belgium | 26/2 R |
| 2201909 | 7/1973 | Fed. Rep. of Germany | 26/16 |
| 657 | of 1853 | United Kingdom | 26/16 |
| 1704 | of 1859 | United Kingdom | 26/30 |
| 1378 | of 1873 | United Kingdom | 26/30 |
| 1047 | of 1880 | United Kingdom | 26/30 |
| 1193588 | 6/1970 | United Kingdom | 26/29 P |

*Primary Examiner*—Robert Mackey

*Attorney, Agent, or Firm*—Earle R. Marden; H. William Petry

[57] ABSTRACT

Apparatus to pattern brush pile fabric which has been pre-heated so that the pattern brushed into the pile fabric will remain as the fabric cools. An adjustable fabric pressure rod positions the fabric in a pre-determined position relative to the bristles of the rotating brush. To provide the desired pattern on the surface of the pile fabric, a plurality of movable reed members deflect the bristles of the rotating brush.

1 Claim, 5 Drawing Figures

APPARATUS TO PATTERN BRUSH PILE FABRIC

This is a continuation of application Ser. No. 22,521, filed Mar. 21, 1979, now abandoned.

It is an object of the invention to provide a pattern effect on the surface of a pile fabric utilizing a brush to accomplish same.

Other objects of the invention will become readily apparent as the specification proceeds to describe the invention with reference to accompanying drawings, in which.

Figure 1:
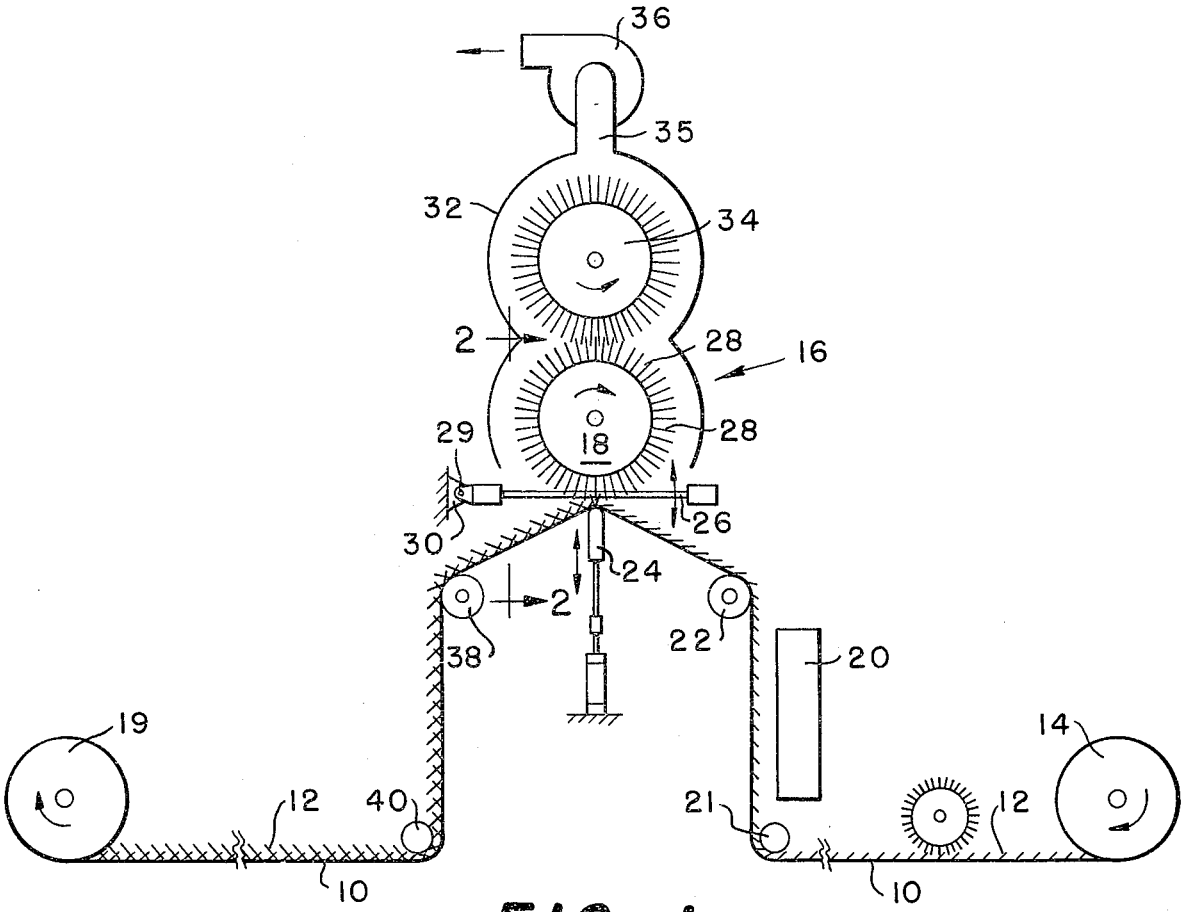
FIG. 1 is a schematic view of the over-all apparatus to produce the desired patterned pile fabric.
Figure 2:
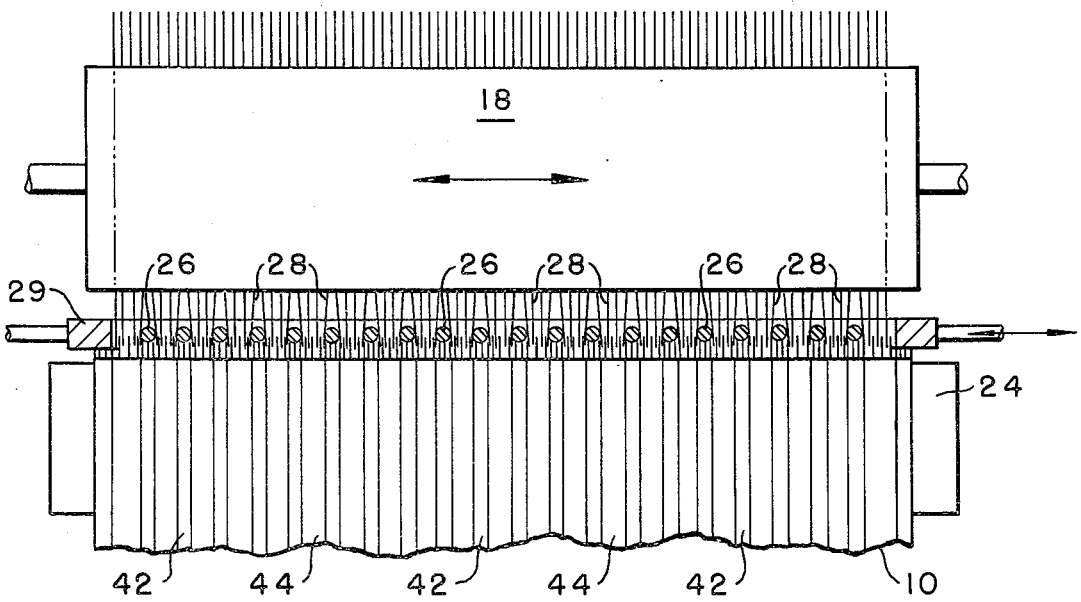
FIG. 2 is a cross-sectional view taken on line 2—2 of FIG. 1.
Figure 3:
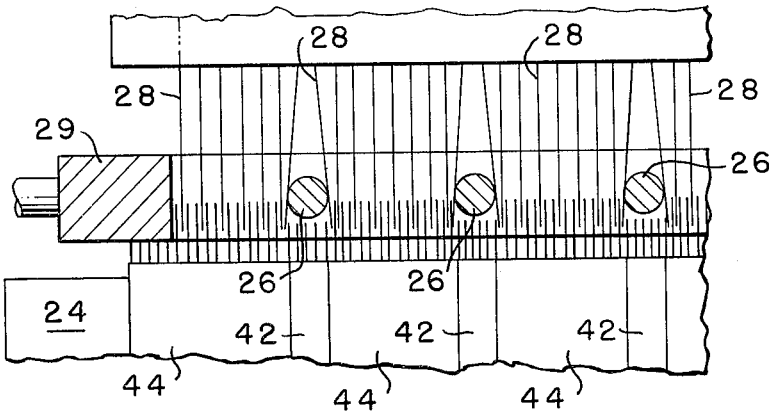
FIG. 3 is a blown-up view of a portion of the apparatus shown in FIG. 2, and FIGS. 4 and 5 show modified patterns which can be brushed into pile fabric by the apparatus shown in FIGS. 1–3.

Looking now to the drawings and especially to FIGS 1–3, the apparatus of the invention is shown. Fabric 10 having a pile 12 of thermoplastic fibers such as acrylic, polyester, nylon, etc. is supplied from a supply roll 14 through the pattern brushing machine, generally indicated by 16, to a driven take-up roll 19. In its travel from the supply roll 14, the fabric 10 is brushed to move the pile 12 in a direction away from the direction of rotation of the rotating brush 18. After the fabric pile 12 has been brushed, the fabric 10 is guided past a heater 20 by idler rolls 21 and 22 to soften the thermoplastic pile 12 prior to brushing by the brush 18. From the idler roll 22, the fabric 10 passes upwardly over the adjustable fabric pressure rod 24 which extends under the full width of the fabric to hold it upward into contact with the bristles 28 of the rotating brush 18. The reed members 26 spread the bristles 28 of the rotating brush 18, thus preventing those bristles from contacting the pile 12. A pattern consisting of brushed and unbrushed regions is thereby produced. For reasons hereinafter explained, the plurality of reeds 26 are pivotally mounted to shaft 29 and shaft 29 is transversely slidable in bearing blocks 30 by any suitable means (not shown). A housing 32 surrounds the rotating brush 18 and the cleaning brush 34 to exhaust collected lint, trash, etc. through the exhaust duct 35 connected to the suction side of the fan 36 which directs the removed trash to a point of collection.

The fabric 10, after being brushed, cools as it passes over the idler rolls 38 and 40 to allow the pattern brushed therein to set prior to take-up on the take-up roll 19. On the fabric 10 being taken up on the take-up roll, the brushed areas will be raised while the unbrushed pile areas will remain in a position lower than the brushed areas to provide the pattern in the fabric.

EXAMPLE I

As described above, the fabric 10 is brushed to move the pile 12 at an angle opposite to the direction of rotation of the brush 18. The fabric 10 is passed by the heater 20 to provide a pile temperature at the brush of 205° F.–215° F. The reed members are fixed in the position shown in FIGS. 1–3, each spaced ¾" from the next adjacent reed members and have a diameter of ⅛". The fabric 10 is a warp knit fabric having a spun staple acrylic pile of approximately 3/32" in length. This fabric is delivered at a speed of three yards/minute past the brush 18 which is rotating in the direction indicated at a speed of 360 revolutions per minute. The cleaning brush 34 is rotating counter-clockwise at at a speed higher than that of the brush 18 to clean accumulated fibers, trash, etc. therefrom. As indicated in FIGS. 1–3, this produces a stripe 42 composed of pile fibers lower than the other pile fibers 44 which have been brushed by the brush 18. The reed members 26 spread the bristles 28 to prevent contact with the stripe 42. The fabric 10 is then supplied to the take-up roll 19 as the fibers are allowed to cool and set the configuration thereon.

EXAMPLE II

Figure 4:
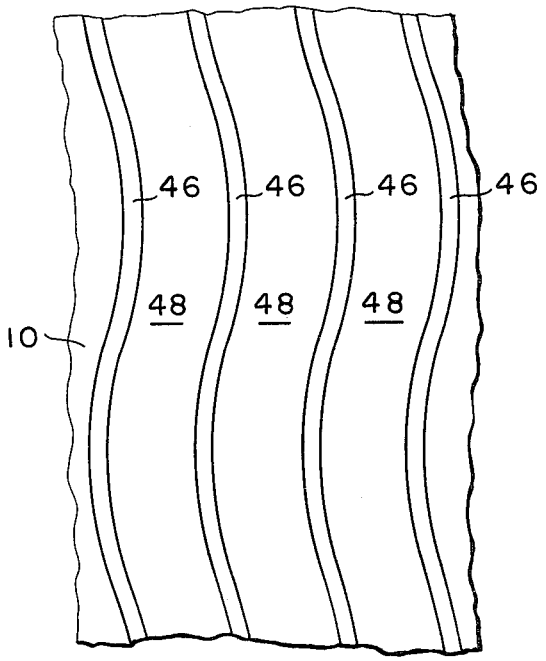

FIG. 4 illustrates another pattern configuration obtained by oscillating the reed members 26 laterally. In the example, the fabric construction, reed wire diameter and reed wire spacing is the same as in Example I. The fabric 10 is delivered to the brush area at a speed of 1–2 yards/minute with a pile temperature in the range of 210° F.–215° F. The speed of the brush 18 is approximately 400 revolutions/minute and the reed members are osciallated at 17 cycles/minute with an amplitude of ⅜" to produce the same wave stripe line 46 of pile fibers lower than the body 48 of the fabric.

In this example, the transverse oscillating of the reeds is uniform to produce a sinusoidal pattern in the fabric 10 but obviously other transverse movements of the reeds can be made to produce other patterns on the fabric.

EXAMPLE III

Figure 5:
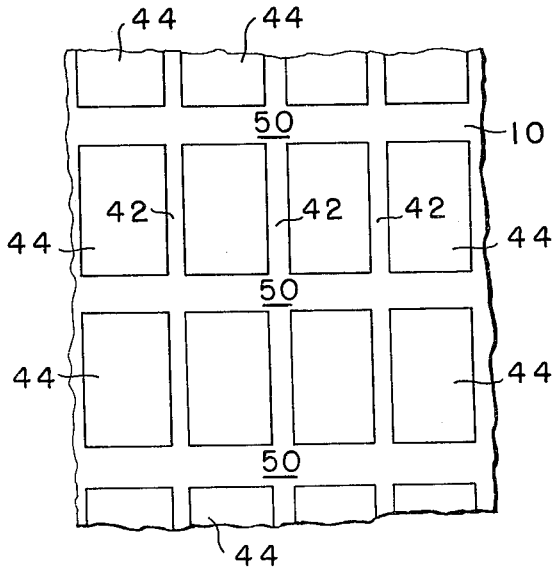

FIG. 5 illustrates a movement when the back-up or pressure rod 24 is moved up and down while the reed wires are not being oscillated transversely. In FIG. 5, the fabric construction and reed wire spacing is the same as in Example I, but the reed wire is 3/32" in diameter. The pile temperature at the brush 18 is approximately 200° F. As in Example I, the reed members 26 prevent the brush bristles 28 from raising the pile 12 in the stripe area 42 but also periodically the bar 24 is reciprocated away from the fabric 10 to allow the fabric to pass out of contact with the brush 18 to provide the transverse stripe areas 50. This provides a fabric having high pile areas 44 and low pile stripe areas 42 and 50. The speed of the fabric and the out-of-contact time of the bar 24 is dependent on the length of high pile areas 44 that is desired.

The above-described examples are preferably obtained on fabrics having a single color so that brushed and unbrushed areas of the fabric tend to cause shade variations to accentuate the pattern produced on the fabric 10. Furthermore, it is possible to reverse the high and low pile areas in the fabric by initially brushing the fabric in the same direction of rotation of the brush 18 to allow the areas under the reed wires to be higher than the brushed areas.

It should also be noted that it is possible to provide other desired patterns in the pile fabric by compound movement of the reed wires and the back-up support bar and depending on speed of movement of the relative members, as well as speed of the fabric, an indefinite number of pattern possibilities are available.

Although the preferred embodiments of the invention have been described, it is contemplated that changes may be made without departing from the scope or spirit of the invention and we desire to be limited only by the scope of the claims.

We claim:

1. Apparatus to produce a patterned high-low pile fabric comprising: a pile fabric supply means, an elongated brush means having bristles thereon rotatably mounted in said apparatus, means to supply pile fabric from said fabric supply means to said brush means, means to heat the pile surface of the pile fabric as it is being supplied to said brush means, a plurality of individual reed members separately and pivotally mounted to said apparatus and projecting into the bristles and spreading a plurality of said bristles one from the other, vertically adjustable elongated bar means to urge the pile surface into and out of contact with the bristles of said elongated brush means whereby the portion of the pile surface adjacent said reed members will not be brushed by said bristles and means to take-up the pile fabric from the brush means and to allow the pile surface thereof to cool.

* * * * *